United States Patent [19]

Shibasaki et al.

[11] Patent Number: 4,678,703

[45] Date of Patent: Jul. 7, 1987

[54] NONWOVEN SHEET HAVING SMOOTH FILMY SURFACE LAYER

[75] Inventors: Akio Shibasaki, Moriyama; Hirofumi Iwasaki, Ashiya, both of Japan

[73] Assignee: Asahi Kasei Kogyo Kabushiki Kaisha, Japan

[21] Appl. No.: 712,239

[22] Filed: Mar. 15, 1985

[30] Foreign Application Priority Data

Mar. 16, 1984 [JP] Japan ..... 59-49229

[51] Int. Cl.[4] ..... B32B 5/00; B32B 31/22; D04H 1/54; D04H 3/14

[52] U.S. Cl. ..... 428/288; 156/308.2; 428/296; 428/409

[58] Field of Search ..... 428/296, 288, 409; 156/308.2

[56] References Cited

U.S. PATENT DOCUMENTS

| | | | |
|---|---|---|---|
| 3,949,130 | 4/1976 | Sabel et al. | 428/409 |
| 3,975,224 | 8/1976 | Ruzek et al. | 156/167 |
| 4,100,319 | 7/1978 | Schwartz | 428/288 |
| 4,129,675 | 12/1978 | Scott | 428/303 |
| 4,189,338 | 2/1980 | Ejima et al. | 156/167 |
| 4,210,690 | 7/1980 | Hartmann et al. | 156/167 |
| 4,342,813 | 8/1982 | Erickson | 428/296 |
| 4,363,682 | 12/1982 | Thiebault | 428/296 |

*Primary Examiner*—James C. Cannon

*Attorney, Agent, or Firm*—Finnegan, Henderson, Farabow, Garrett & Dunner

[57] ABSTRACT

A tenacious polyethylene terephtalate filament nonwoven sheet having at least one smooth filmy surface layer, bulkiness, resistance to fuzzing by friction, and a high tear strength. In the smooth filmy surface, filaments forming the same surface layer are crushed flat and buried with each other at the crossing sections. The average roughness of the smooth filmy surface is 25μ or below. Accordingly, the nonwoven sheet has excellent printing effect and resistance to frictional fuzzing. In a layer next to the surface layer, a plurality of filaments adhere closely to each other and practically maintain the original from thereof. Accordingly, the nonwoven sheet has bulkiness and high tear strength.

8 Claims, 7 Drawing Figures

NONWOVEN SHEET HAVING SMOOTH FILMY SURFACE LAYER

BACKGROUND OF THE INVENTION

1. Field of the Invention

The present invention relates to a nonwoven sheet consisting of polyethylene terephthalate (designated as "Polyester" hereinafter) filaments, constructed by entangling the filaments in a three-dimensional state, and having at least one smooth filmy surface layer, more specifically to a tenacious polyester filament nonwoven sheet having at least one smooth filmy surface layer, bulkiness, resistance to fuzzing by friction, and a high tear strength.

2. Description of the Related Art

Nonwoven sheets are used currently as printing substrates and packing materials. A nonwoven sheet (Japanese Examined Patent Publication (Kokoku) No. 4219520 ) constructed of extra fine polyolefin filaments is used widely because of its desirable smooth surface. Constructed of polyolefin filaments, this nonwoven sheet is inferior in printability and heat resistance. Furthermore, constructed of extrafine filaments, this nonwoven sheet has low tear strength. That is, the finer component filaments give a structure having a highly smooth surface, however, reduce the tear strength of the structure. To produce a heat resistant nonwoven sheet having a smoother surface and a higher tear strength, trials have been made to form a smooth surface by using a nonwoven sheet consisting of drawn polyester filaments. According to a known process for smoothing the surface of a nonwoven sheet, the surface filaments are heat-pressed for adhesion with a roll having a smooth surface.

In this process, the surface of the nonwoven sheet needs to be heat-pressed at a temperature near the melting point of the component filaments to smooth the surface. At such a critical temperature, the component filaments melt and are changed into a resinoid state, and hence the nonwoven sheet thus produced is embrittled. On the other hand, under a heat-pressing condition which will not resinify the component filament, the surface of the nonwoven sheet is merely flattened, and hence a satisfactorily smooth surface cannot be formed and the surface is liable to become fuzzy when subjected to friction, due to the weak bonding between the filaments.

Another method of producing a nonwoven fabric having a smooth filmy surface layer is known from Japanese Examined Patent Publication (Kokoku) No. 4841115. In this method, a nonwoven fabric constructed of polyester filaments with a second order transition point below room temperature is heat-pressed to make the surface thereof smooth. In this nonwoven fabric, since the second order transition point of the filaments is below room temperature, the resistance to heat of the nonwoven fabric is low so that the nonwoven fabric is not suitable for practical use.

According to still another process, the surface of a nonwoven sheet is coated with a smooth resin layer to form a smooth surface. This process, in general, reduces the tear strength of the nonwoven sheet, though this is dependent on the type and quantity of the resin used.

In view of the problems in the prior art, the inventors of the present invention intended to form a smooth surface by using heat-resistant filaments which can readily be deformed by heat-pressing, such as undrawn polyester filaments of a low softening point. Although a smooth surface could be formed, simple heat-pressing treatment of the web consisting of such filaments produced a stiff and lean nonwoven sheet of an extremely low tear strength, because of the general flattening of the filaments of a low softening point.

SUMMARY OF THE INVENTION

Accordingly, it is an object of the present invention to provide a bulky and highly tenacious polyester filament nonwoven sheet of a high tear strength, having at least one smooth filmy surface layer and resistant to fuzzing by friction.

The object of the present invention is achieved by a nonwoven sheet consisting practically of polyester filaments and constructed by entangling the filaments in a three-dimensional state, characterized in that at least one of the surface layers thereof is a smooth filmy layer of an average roughness of 25 μor below, formed by flattening the surface layer so that the filaments forming the same surface layer crush flat and bury each other at the crossing sections and are fused at the intersecting surfaces, and the layer next to the surface layer consists of a plurality of filaments adhering closely to each other and practically maintaining the original form thereof.

BRIEF DESCRIPTION OF THE DRAWINGS

FIG. 4(*b*) is a schematic view illustrating the morphology of the component filaments in the thickness direction of the cross-section of the nonwoven sheet produced by heat-pressing by means of a pair of an upper roll and a lower roll having the same temperature, being a view of the same type as FIG. 4(*a*);

DESCRIPTION OF THE PREFERRED EMBODIMENTS

Figure 1:
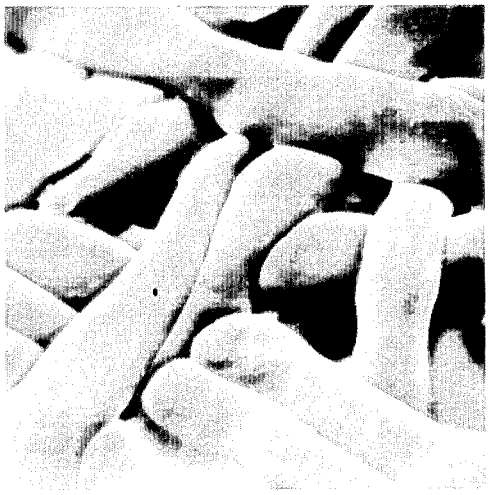
FIG. 1 is a microscopic photograph at a 500× magnification of the surface of the smooth filmy layer of a nonwoven sheet according to the present invention, showing the morphology of the component filaments in the smooth filmy layer.

The inventors of the present invention made zealous studies to improve the drawbacks of the nonwoven sheet consisting of the above mentioned undrawn polyester filaments and have thus made the present invention, in which a nonwoven sheet comprises a layer consisting of flattened filaments and a layer consisting of filaments practically maintaining the fibrous form.

Since this invention concerns a novel nonwoven sheet characterized by special measurements, the various characteristics and measurements that are used through this application are described and defined below:

Average degree of roughness

The difference between the respective means of maximum peak values and minimum peak values obtained from surface roughness charts obtained through the measurement of the surface roughness of sample pieces using SURFCOM 200B (Tokyo Seimitsu K.K.), a measuring instrument specified in Japan Industrial Standard (JIS) B 0651-76.

Tensile strength and elongation (on basis of JIS L 1096A)

The means of breaking strengths and elongations of test pieces of 3 cm × 20 cm sampled at at least three widthwise positions and three lengthwise positions from a sample nonwoven sheet, measured on a constant extension rate type tensile tester with a test length of 10 cm and an extension rate of 20 cm/min.

Tear strength (on basis of JIS L 1096 D)

The mean of measured tear strengths of test pieces sampled at at least three widthwise positions and at least three lengthwise positions, measured on an Elemendorf type tear strength tester in accordance with JIS L 1096.

Abrasion resistance (on basis of JIS L 0823)

The results of comparing the appearance of test pieces of 3 cm × 20 cm sampled from a sample nonwoven sheet with the following judgement standard after rubbing each test piece with the abrasion tester type II (GAKUSHIN-Type, cotton rubbing cloth, 500 g weight, 100 repeated rubbings).

Grade A: Not fuzzy at all.
Grade B: Slightly fuzzy, but not conspicuous.
Grade C: Remarkably fuzzy.

Shrinkage (on basis of JIS L 1042 A)

The means of the widthwise shrinkages and the lengthwise shrinkage of the 20 cm × 20 cm sections of test pieces of 25 cm × 25 cm, after heating at 150° C. for 5 min in a hot air dryer.

Birefringence index

Birefringence index ($\Delta n$) measured by a polarization microscope with a Belex type compensator under white light.

Bulkinees (on basis of JIS L 1096)

The volume per unit weight ($cm^3/g$) calculated by the weigh and the thickness measured by a dial gauge of at least three test pieces of 20 cm × 20 cm.

Curling

Degree of curling of a test piece of 25 cm × 25 cm placed on a table, determined through visual observation.

Grade A: Remaining flat.
Grade B: Curling slightly at the edges.
Grade C: Rolling.

Surface waviness

Degree of surface waviness of a test piece of 25 cm × 25 cm after heating the test piece at 150° C. for 5 minutes in a hot air dryer, determined through visual observation.

Grade A: Flat.
Grade B: Slightly wavy, but not conspicuous
Grade C: Wavy over the entire area.

Now, the polyester filaments employed in the present invention are produced by spinning a material produced through a well-known process of polymerization and may contain additives added ordinarily to polyethylene terephthalate, such as a delustering agent, an antistatic agent, a flame retarder, and a pigment. The degree of polymerization is not limited to any particular value, as far as the degree of polymerization is within an ordinary range of polymerization degree for producing filaments.

The inventors of the present invention formed a smooth filmy layer by flattening a plurality of filaments arranged in a surface layer of a nonwoven sheet in random orientation so that the filaments crush flat and bury each other at the crossing sections and are fused at the intersecting surfaces and the adjacent sections. The resultant nonwoven sheet, in spite of consisting of a plurality of filaments, had a smooth surface layer of 25 $\mu$ average roughness or below. The layer extending under the filmy surface layer is constructed so that the degree of crushing of the component filaments is decreased toward the inner side of the layer and the component filaments adhere closely to each other, practically maintaining the original form, to give satisfactory bulkiness and tear strength of the nonwoven sheet.

Figure 2:
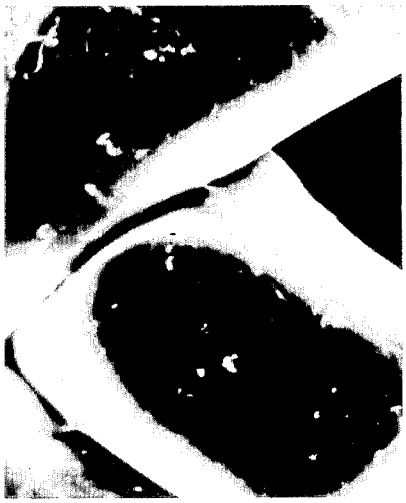
FIG. 2 is a microscopic photograph of a further increased magnification of 2000×, showing the morphology of the component filaments in the surface of the nonwoven sheet of FIG. 1.
Figure 3:
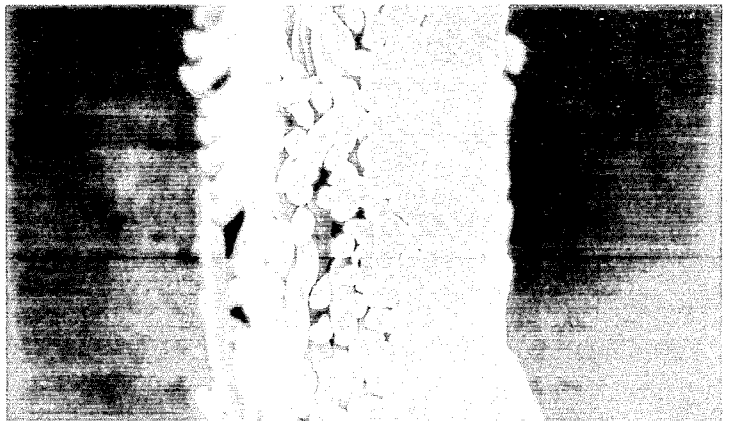
FIG. 3 is a microscopic photograph at a 200× magnification of a section of a nonwoven sheet according to the present invention, showing the morphology of the component filaments.

The morphology of the component filaments of a nonwoven sheet according to the present invention will be described in conjunction with FIGS. 1, 2 and 3. FIGS. 1 and 2 are microscopic photographs at 500× and 2000× magnifications, respectively, showing the forms of the filaments in the surface of the nonwoven sheet. As apparent from FIGS. 1 and 2, the intercrossing filaments bury each other in the intersecting sections and the adjacent filaments are in close contact with each other without any gap therebetween so as to be unified. Consequently, the filaments form a continuous smooth filmy layer. As apparent from FIG. 3 showing a microscopic photograph of a section of nonwoven sheet of the present invention and FIG. 4(*a*), schematically showing the section of the nonwoven sheet, in the layer 2, 3 extending below the filmy surface layer 1, the original form of the filaments is maintained and the filaments are softened so as to be in close contact with each other, except that the intersecting sections are partly fused together.

Figure 5:
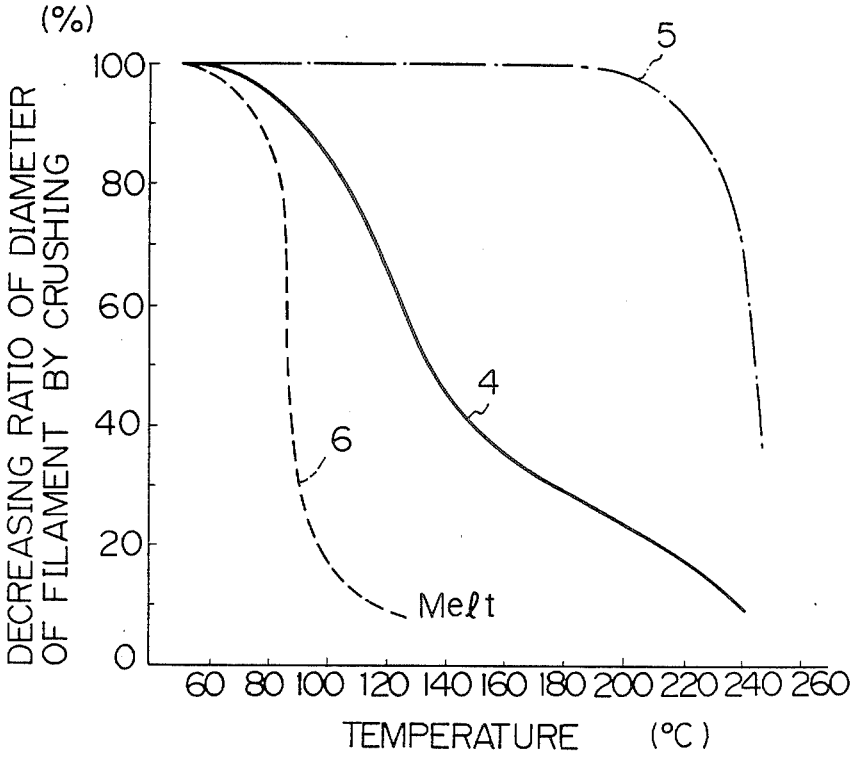
FIG. 5 is a graph showing the variation of the relative difficulty of crushing a filament with heating temperature for the draw ratio of polyester filaments used for forming the nonwoven sheet of the present invention.

The mechanism of the mutual burying phenomenon between the filaments will be explained hereunder with reference to FIG. 5 showing the effect of the draw ratio (represented by index of birefringence herein) on the relative difficulty of crushing the filament. A plurality of filaments were rolled by a pair of rollers, a silicon rubber roller, and a metallic roller, under a line pressure of 20 kg/cm and various levels of top roller temperature to examine the relative crushing difficulty through the measurement of the flatness. The term "flatness" used herein is the ratio of the minor axis $l_2$ to the major axis $l_1$, namely, $l_2/l_1$ of the practical elliptic cross-section of a crushed filament.

FIG. 5 shows the variation of flatness with rolling temperature, for polyester filaments having a birefringence index $\Delta n=0.041$ used for forming a nonwoven sheet, in a second example according to the present invention (Curve 4), filaments drawn at a lower draw ratio relative to that for the filaments of the second example, having a birefringence index $\Delta n=0.010$ and used for forming a reference nonwoven sheet No. 4 (Curve 6) and filaments drawn at a high drawn ratio, having a birefringence index $\Delta n=0.097$ and used for forming a reference nonwoven sheet No. 5 (Curve 5).

Referring to FIG. 5 as regards the filaments employed in the second example of the present invention, the crushing effect increases gradually with temperature after around 100° C., whereas the crushing effect on the filaments of Curve 6 increases sharply at a low temperature. On the other hand, the filaments of Curve 5 are highly resistant to deformation and flattened suddenly at a temperature near the melting point. Accordingly, a polyester filament nonwoven sheet having a construction according to the present invention can be produced by heat-pressing filaments having such thermal properties as indicated by Curve 4 under a suitable pressure and temperature.

In constructing a nonwoven sheet according to the present invention, a high density of intersections of filaments is desirable to form a continuous smooth filmy layer. According to the present invention, in view of enhancing the bulkiness and tear strength, the desirable thickness of the smooth filmy layer is less than half of the thickness of the nonwoven sheet.

In producing a nonwoven sheet of the present invention, it is essential to construct a layer below the smooth filmy layer so that the filaments therein are not fused together, but softened to yield to each other so as to be in close contact with each other, in order to obviate the deterioration of the tear strength and to secure bulkiness.

Figure 6:
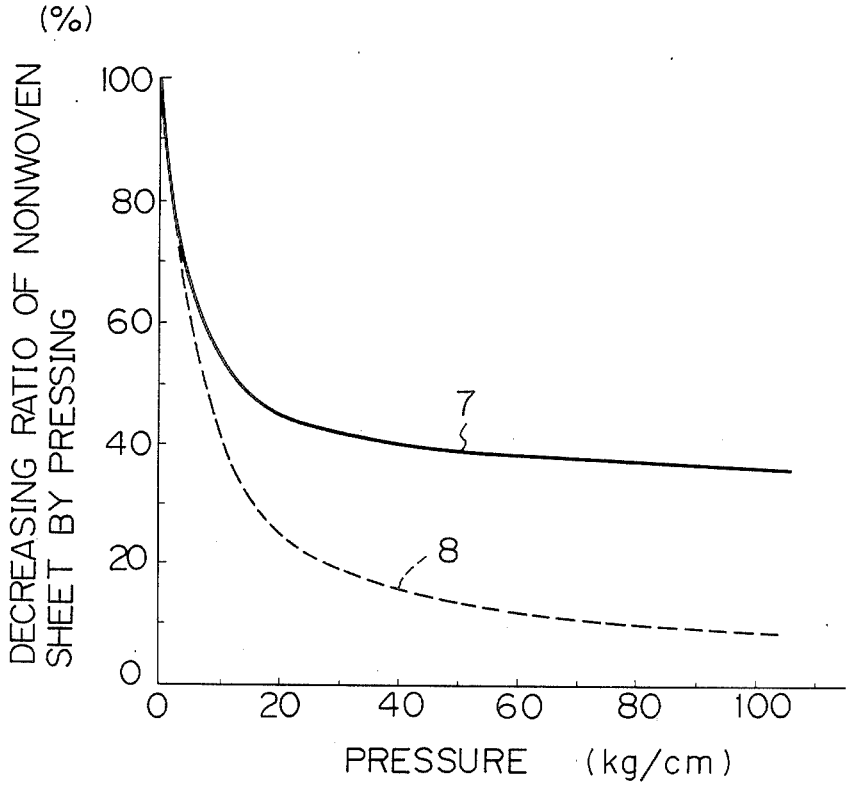
FIG. 6 is a graph showing the variation of the thickness of the smooth filmy layer of nonwoven sheet according to the present invention when producing the smooth filmy layer by changing the pressure of the rolls.

FIG. 6 shows the variation of the thickness where changing the pressure of the rolls when producing the smooth filmy layer in the nonwoven sheet.

Figure 4A:
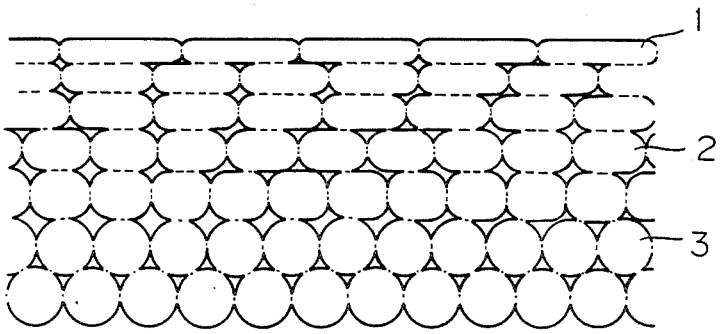
FIG. 4(*a*) is a schematic view illustrating the morphology of the component filaments in the thickness direction of the cross-section of the nonwoven sheet according to the present invention, assuming that each filament is arranged in the direction perpendicular to the surface of the drawing to clearly explain the constitution of the nonwoven sheet.
Figure 4B:
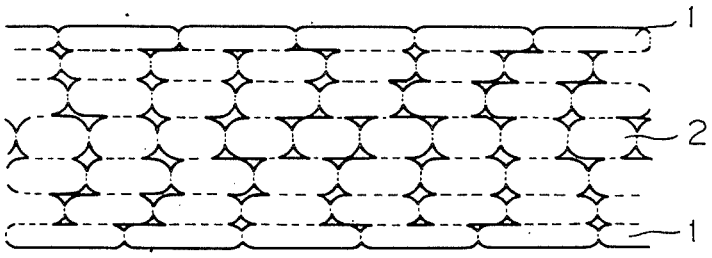

In FIG. 6, a Curve 7 shows a nonwoven sheet corresponding to the nonwoven sheet having a structure schematically illustrated in FIG. 4(*a*) and formed with the smooth filmy layer by providing a difference of temperature between a top roll and a bottom roll. A Curve 8 shows a nonwoven sheet corresponding to the nonwoven sheet having a structure schematically illustrated in FIG. 4(*b*) and formed with the smooth filmy layer by using a top roll and bottom roll having the same temperature. As apparent from the Curve 7 in FIG. 7, it is possible to control the thickness of the nonwoven sheet to nearly constant thickness, e.g., about 50 percent of the initial thickness, where a difference of temperature is provided between the top roll and the bottom roll to heat-press the nonwoven sheet, as with the nonwoven sheet according to the present invention. It is impossible to control the thickness of the nonwoven sheet in the case shown in the Curve 8 of FIG. 6. Therefore, formation of the smooth filmy layer having a suitable thickness in the total thickness of the nonwoven sheet can be adjusted by setting an adequate temperature and pressure when the method of setting a difference between temperatures of the top roll and the bottom roll is adopted.

Undrawn polyester filaments are used for forming a nonwoven sheet of the present invention. The preferable birefringence index $\Delta n$ of the undrawn polyester filaments is within the range from 0.02 to 0.07. Filaments less than 0.02 in birefringence index $\Delta n$ are deteriorated and embrittles by heat when fused and the excessively low softening point thereof inhibits forming a smooth filmy layer only in part of the cross-section of the nonwoven sheet, namely, only over the surface of the nonwoven sheet, whereas filaments over 0.07 in birefringence index $\Delta n$ has a high softening point, which mades it difficult to crush and flatten the filaments. Hence, a satisfactory smooth surface cannot be formed and the surface layer is liable to be fuzzed by friction, due to insufficient bonding between the filaments. The object of the present invention is achieved only by using undrawn polyester filaments selected by taking into consideration the above mentioned conditions for forming a nonwoven sheet.

Incidentally, a birefringence index of the polyester filaments in the nonwoven sheet according to the present invention is increased by the heat-pressing and a heat-setting described hereinafter used for obtaining the structure of the nonwoven sheet according to the present invention.

An example of a process for manufacturing a nonwoven sheet of the present invention will be described hereinafter. A web consisting of filaments having a birefringence index within the above mentioned range is formed by suitably varying the spinning speed in the spun bonding process in which melt-spun continuous filaments are drawn by the agency of a high-speed air current, and then the drawn filaments are arranged directly in the form of a web on a moving conveyor.

The web thus formed is heat-pressed for adhesion by a pair of smooth heat rollers. To produce a nonwoven sheet of a construction according to the present invention, the top heat roll and the bottom heat roll are differentiated from each other in temperature, and an appropriate pressure is applied to the web by those heat rolls. The temperature of either one of those heat rolls is 100° C. to 230° C., preferably, 120° C. to 220° C., while that of the other heat roll is 20° C. to 100° C., preferably, 40° C. to 80° C. The preferable temperature difference between those rolls is at least 50° C. The line pressure between the heat rolls is 5 to 100 kg/cm. Those conditions of the process are selectively and appropriately decided according to the weight per unit area of the nonwoven fabric to be produced.

The heat-pressing may be carried out in two stages, namely a first stage employing a comparatively low heat-pressing temperature (around 60° C. to 100° C.) for initial pressure-bonding and a second stage employing the predetermined heat-pressing temperature for finishing pressure-bonding. Such a two-stage heat-pressing process avoids irregularity in the weight per unit area resulting from the irregular shrinkage of the filaments of the web atributable to a sudden change in temperature, which is inevitable in a one-stage heat-pressing process.

In a nonwoven sheet of the present invention, the smooth filmy layer is formed at least on one side of the nonwoven sheet, however, the smooth filmy layer may be formed over both sides of a nonwoven sheet, if necessary. When necessary, the smooth filmy layer is formed over one side of a nonwoven sheet, and then the same is formed over the other side through the same process.

The nonwoven sheet of the present invention may contain filaments of the type different from that mentioned above, so far as the object of the present invention is achieved. When a nonwoven sheet is desired to be formed by filaments of different types, first a mixed web containing the undrawn polyester filaments meeting the above-mentioned appropriate conditions and polyester filaments drawn at a different draw ratio from that of the former or filaments of a different type, such as polyamide filaments or polyolefin filaments, are mixed at a mixing ratio which will not make it impossible to achieve the object of the present invention. Then, the mixed web is subjected to heat-pressing. Or, first a laminated web of different filaments is subjected to an mechanical intertangling process, such as a needle punching process and then, the intertangled laminated web is subjected to heat-pressing.

Basically, the nonwoven sheet of the present invention is formed by undrawn polyester filaments, therefore, the nonwoven sheet shrinks easily when heated and the surface is liable to be wavy when heated. Accordingly, it is desirable to finish the nonwoven sheet by heat-setting, if the use requires. Furthermore, the nonwoven sheet of the present invention has a twolayer construction consisting of a surface layer and a layer extending below the same. Therefore, the nonwoven sheet has waviness and tends to curl. The curling of the nonwoven sheet can be straightened by heat-setting. According to the present invention, the nonwoven sheet is heat-set at a temperature within the range from 120° C. to 180° C. for several tens of seconds depending on the purpose.

Furthermore, the nonwoven sheet of the present invention may be finished through a well-known finishing treatment, such as embossing, dyeing, resin finishing, water repellency treatment, and/or antistatic treatment.

The desirable fineness of the component filaments of the nonwoven sheet of the present invention is 50 denier or less, preferably, 0.5 to 30 denier. The nonwoven sheet may be formed by filaments of the same fineness or by a mixture of filaments of different finenesses. Ordinarily, the weight per unit area of the nonwoven sheet of the present invention is a value within the range from 50 to 500 g/m$^2$, however, the weight per unit area is not limited particularly.

The present invention will now be described concretely with reference to examples.

Five webs of 100 g/m$^2$ weight per unit area were formed by spinning polyethylene terephthalate of 0.75 intrinsic viscosity with a rectangular spinning nozzle with 1000 holes of 0.25 mm diameter at a melt temperature of 290° C. and a discharge rate of 850 g/min, at different spinning speeds controlled by an air sucker. These webs were heat-pressed with a pair of rollers having a smooth surface, namely, a top roll and a bottom roll of 190° C. and 50° C., respectively, under a line pressure of 70 kg/cm. The properties of the webs thus produced are tabulated in Table 1.

TABLE 1

| | | | Properties of nonwoven sheet | | | | | | | | |
|---|---|---|---|---|---|---|---|---|---|---|---|
| | Spinning speed | Birefringence of filaments | Average degree of roughness | Tensile strength (kg/3 cm) | | Extension at break (%) | | Tear strength (kg) | | Abrasion resistance | Bulkiness |
| | (m/min) | (Δn) | (μ) | W | F | W | F | W | F | (Grade) | (cm$^3$/g) |
| Example 1 | 2200 | 0.023 | 10 | 12 | 8 | 52 | 65 | 3.1 | 1.6 | A | 1.05 |
| Example 2 | 3000 | 0.041 | 14 | 14 | 10 | 58 | 74 | 3.5 | 2.3 | A | 1.15 |
| Example 3 | 3900 | 0.062 | 18 | 15 | 10 | 63 | 80 | 4.0 | 3.2 | A | 1.25 |
| Example 4 (reference) | 1300 | 0.010 | — | — | — | — | — | — | — | — | — |
| Example 5 (reference) | 5000 | 0.097 | 35 | 4 | 3 | 3 | 3 | 2.5 | 2.1 | C | 1.95 |

Remarks
W: the lengthwise direction of the sheet
F: the widthwise direction of the sheet Table 1 shows Examples 1, 2, and 3 of a nonwoven sheet made of filaments with birefringence indexes within the range from 0.02 to 0.07 according to the present invention and reference examples 4 and 5.

In Table 1, the values in the column of "Birefringence of Filament" is those of filaments forming the webs, measured before heat-pressing.

As apparent from Table 1, examples 1, 2, and 3 of the present invention are bulky and tenacious nonwoven sheets of an average degree of roughness of 25 μ or below, having high tear strength and perfectly resistant to frictional fuzzing. On the contrary, in reference example 4, no nonwoven sheet is formed because the filaments are fused. The nonwoven sheet of reference example 5 is formed by using a polyester filament produced by a high draw ratio and by crushing only the surface layer of the nonwoven sheet. Therefore, binding between single filaments in this nonwoven sheet is weak and the sheet is fuzzed by surface abrasion. The smoothness of the surface, the tensile strength, and the extension at break of this nonwoven sheet are also poor.

The nonwoven sheets of examples 1, 2, and 3 were heat-set on a pin tenter machine at 160° C. for 20 seconds to form the nonwoven sheets of examples 6, 7, and 8. The properties of the nonwoven sheets before and after heat-setting are shown in Table 2.

As shown in Table 2, the heat-setting treatment improved the shrinkage, surface waviness, and curling of the nonwoven sheets.

TABLE 2

| | Before heat-setting | | | | | | After heat-setting | | | | |
|---|---|---|---|---|---|---|---|---|---|---|---|
| | Heat shrinkage (%) | | Surface waviness | Curing | Average degree of roughness | | Heat shrinkage (%) | | Surface waviness | Curing | Average degree of roughness |
| | W | F | (Grade) | (Grade) | (μ) | | W | F | (Grade) | (Grade) | (μ) |
| Example 1 | 4 | 3 | C | C | 10 | Example 6 | 0 | 0 | A | A | 12 |
| Example 2 | 3 | 2 | B | B | 14 | Example 7 | 0 | 0 | A | A | 16 |
| Example 3 | 2 | 2 | B | B | 18 | Example 8 | 0 | 0 | A | A | 19 |

The nonwoven sheet of example 2, one of the sides of which is smooth, was subjected to heat-pressing, in which a line pressure of 70 kg/cm was applied to the nonwoven sheet by using a pair of rolls each having a smooth surface. The respective temperatures of the rolls, namely, the top roll and the bottom roll, were 190° C. and 50° C. The nonwoven sheet was passed between the top roll and the bottom roll so that the side opposite the smooth side was in contact with the top roll. The properties of the thus heat-pressed nonwoven sheet (example 9) is shown in Table 3.

TABLE 3

| | Avg. deg. of roughness (μ) | | Tensile strength (kg/3 cm) | | Extension at break (%) | | Tear strength (kg) | | Abrasion resistance (Grade) | | Bulkiness |
|---|---|---|---|---|---|---|---|---|---|---|---|
| No. | Front | Back | W | F | W | F | W | F | Front | Back | ($cm^3/g$) |
| Example 9 | 12 | 13 | 15 | 11 | 50 | 65 | 2.5 | 1.7 | A | A | 0.95 |

As shown in Table 3, example 9 is a tenacious nonwoven sheet smoothed on both sides and having a high tear strength.

A laminated web consisting of two outer layers of webs each having the same constitution as that of the web of example 2, except that the weight per unit area is 50 g/m$^2$, and an intermediate layer of a web having the same constitution as that of reference example 5, except that the weight per unit area is 50 g/m$^2$, and being interposed between the former webs was subjected to needle punching to intertangle the component filaments of the webs. The needle punching conditions were: needle gauge: #40, needling depth: 13 mm and needling times: 50 times/cm$^2$. Then, the needle-punched laminated web was subjected to heat-pressing twice to smooth both sides. The conditions of the heat-pressing process were: the temperature of the top roll: 210° C., the temperature of the bottom roll: 50° C., and the line pressure: 20 kg/cm. The properties of the thus formed nonwoven sheet (example 10) are shown in Table 4.

TABLE 4

| | Avg. deg. of roughness (μ) | | Tensile strength (kg/3 cm) | | Extension at break (%) | | Tear strength (kg) | | Abrasion resistance (Grade) | | Bulkiness |
|---|---|---|---|---|---|---|---|---|---|---|---|
| No. | Front | Back | W | F | W | F | W | F | Front | Back | ($cm^3/g$) |
| Example 10 | 13 | 14 | 21 | 13 | 53 | 69 | 5.3 | 3.8 | A | A | 1.37 |

As shown in Table 4, the laminated nonwoven sheet formed by laminating a web of undrawn polyester filaments and webs of undrawn polyester filaments according to the present invention and by mechanically intertangling the component filaments was satisfactory in all properties, namely, smoothness, tensile strength, elongation, and abrasion resistance, and had excellent bulkiness and high tear strength.

The nonwoven sheet of the present invention thus constituted has at least one smooth surface and is capable of clean printing. Furthermore, the polyester filament nonwoven sheet of the present invention is tenacious, bulky, and resistant to frictional fuzzing and has high tear strength compared with paper, film and the like. Accordingly, the nonwoven sheet of the present invention is capable of being applied to diverse purposes, as manufactured or after printing, as industrial materials or as materials for general goods in which durability and printability count, such as for envelopes for floppy disks. Especially, the nonwoven sheet according to the present invention can be used as material for bags or sacks, labels, tags, wrapping material for food, printing substitutes, and the like.

We claim:

1. A nonwoven sheet consisting essentially of polyethylene terephthalate filaments with a birefringence index within the range of from 0.02 to 0.07 and constructed by entangling the filaments in a three-dimensional state wherein at least one of the surface layers thereof is a smooth filmy layer of an average roughness of 25μ or below, formed by flattening said surface layer so that the filaments forming the same surface layer crush flat and bury each other at the crossing sections and are fused at the intersecting surfaces, and the layer next to said surface layer consists of a plurality of filaments adhering closely to each other and practically maintaining the original form thereof.

2. A nonwoven sheet according to claim 1, characterized in that all filaments used in said nonwoven sheet are polyethylene terephtalate filaments having the same birefringence index within the range from 0.02 to 0.07.

3. A nonwoven sheet according to claim 1, characterized in that filaments used in said nonwoven sheet are at least two types of terephtalate filaments having different birefringence indexes within the range from 0.02 to 0.07.

4. A nonwoven sheet according to claim 1, characterized in that filaments forming at least one of the surface layers thereof are polyethylene terephtalate filaments having a birefringence index within the range from 0.02 to 0.07, whereas filaments forming the layer next to said surface layer are other filaments differing from the filaments forming said surface layer thereof.

5. A nonwoven sheet according to claim 1, characterized in that the fineness of the filaments forming said nonwoven sheet is a value within the range from 0.5 to 30 denier.

6. A nonwoven sheet according to claim 1, characterized in that a weight per unit area thereof is a value within the range from 50 to 500 $g/m^2$.

7. A nonwoven sheet according to claim 1, characterized in that said smooth filmy surfaces are formed on both sides of the nonwoven sheet.

8. A nonwoven sheet according to claim 1 wherein the layer next to said surface layer consists of a plurality of unfused filaments adhering closely to each other and practically maintaining the original form thereof.

* * * * *